US007329040B2

(12) United States Patent
Elrod

(10) Patent No.: US 7,329,040 B2
(45) Date of Patent: Feb. 12, 2008

(54) CHAIN LINK MIXING ACCESSORY FOR DRILLS

(76) Inventor: William N. Elrod, 2038 Kai Dr., Sarasota, FL (US) 34231

( * ) Notice: Subject to any disclaimer, the term of this patent is extended or adjusted under 35 U.S.C. 154(b) by 0 days.

(21) Appl. No.: 11/442,768

(22) Filed: May 30, 2006

(65) Prior Publication Data

US 2007/0104024 A1 May 10, 2007

Related U.S. Application Data

(60) Provisional application No. 60/734,616, filed on Nov. 8, 2005.

(51) Int. Cl.
*B01F 7/00* (2006.01)

(52) U.S. Cl. ..... 366/129; 366/343; 366/607

(58) Field of Classification Search ..... 366/129, 366/279, 328.2, 342–343, 607, 308, 326.1
See application file for complete search history.

(56) References Cited

U.S. PATENT DOCUMENTS 1,703,956 A 3/1929 Royer
3,138,300 A * 6/1964 Rintala
3,381,942 A * 5/1968 Wood
3,392,922 A * 7/1968 Lindgren
3,567,078 A * 3/1971 Herr et al.
4,002,491 A * 1/1977 Esparza
4,451,004 A * 5/1984 Ostergren et al.
4,472,852 A * 9/1984 Dill
4,572,258 A 2/1986 Mischel
4,594,745 A * 6/1986 Pierce
4,947,906 A * 8/1990 Schroeder
4,957,404 A * 9/1990 Lepley
4,975,013 A * 12/1990 Lepley
5,495,796 A * 3/1996 Mueller
5,613,425 A * 3/1997 Krznaric
6,863,430 B2 3/2005 Berube
2001/0039902 A1* 11/2001 Hedley et al.
2007/0104024 A1* 5/2007 Elrod

FOREIGN PATENT DOCUMENTS

DE 2906558 A1 * 8/1979
GB 1383046 * 2/1975

* cited by examiner

*Primary Examiner*—Charles E. Cooley
(74) *Attorney, Agent, or Firm*—Gifford, Krass, Sprinkle, Anderson & Citkowski, P.C.

(57) ABSTRACT

A mixing tool for use with a hand held drill motor having a rotatable shaft and a flexible mixing member in the form of a link chain fastened to one end of the shaft to extend radially in the material to be mixed and cause mixing upon rotation of the shaft.

11 Claims, 3 Drawing Sheets

CHAIN LINK MIXING ACCESSORY FOR DRILLS

RELATED APPLICATION

This application claims priority of U.S. Provisional Patent Application Ser. No. 60/734,616 filed Nov. 8, 2005, which is incorporated by reference.

FIELD OF THE INVENTION

This invention relates to mixing or agitation of materials and more particularly to a mixing tool using chain flails.

BACKGROUND OF THE INVENTION

A variety of tools have been provided for use with power tools for mixing various ingredients such as paint, plaster, dry wall joint compound, adhesive, etc. Typically such accessories or tools have limitations under use because they are difficult to store or to insert into a container with the material to be mixed. Also, the mixing portion of the tool usually is rigid and may be damaged or cause damage to the container in which it is being used when the rigid portions engage the interior sides of the container. Also, many of the prior art mixing tools are confined to one size or shape of container or rely on the container or its cover to support the mixing tool during its operation.

SUMMARY OF THE INVENTION

To overcome these objections the present invention incorporates a flexible mixing member in the form of a chain flail which has no sharp edges to damage or pierce the walls of the container in which the tool is being used.

The flexible mixing member of the present invention is fixed to one end of a rod the other end of which can be locked in the chuck of a hand held drill. Upon rotation of the rod the chain links extend radially outwardly from the axis of rotation to achieve a wide span of mixing.

It is an object of the invention to provide a mixing tool in which the mixing elements are collapsible so that the tool can be inserted through a small opening in the container of the materials to be mixed.

Another object of the invention is to provide a mixing tool for various liquid and dry materials which is easy to clean and store.

Still another object of the invention is to provide a mixing tool which has no sharp edges to cause damage to the walls of a container in which the tool is being used.

The objects of the invention are accomplished by a mixing tool having a rotational shaft with one end adapted to be connected to a source of power such as an electric motor or a chuck of a hand held drill. The other end of the shaft is provided with a pair of chain flails each made up of an equal number of chain links and arranged to extend radially outwardly due to the centrifugal force on the chain during the rotation of the shaft. The chain links can be inserted through a small opening having a diameter slightly larger than the maximum dimension of a single chain link. Once inserted in the mixing container and rotated the chain links can occupy a wide span of agitation and mixing substantially larger than the opening through which the tool was inserted.

DETAILED DESCRIPTION OF THE INVENTION

Figure 1:
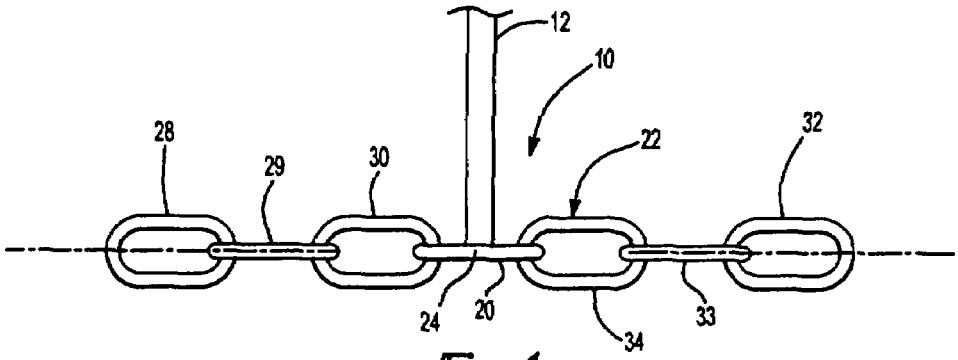
FIG. 1 is a front elevation of the mixing tool embodying the invention with the flexible mixing member or chain extended as it would appear during rotation of the tool.

The mixing tool of the present invention is designated generally at 10 in FIG. 1 and includes a rotatable shaft 12 having an upper end 14 which can be received in a chuck 16 of a hand held electric drill 18 seen in FIGS. 4-7. The lower end 20 of the shaft is provided with a flexible mixing member or chain flail designated at 22. Chain flail 22 is made up of an odd number of chain links with the center link 24 rigidly fastened to the lower end 20 of shaft 12. This makes an equal number of links available to opposite sides of the axis of rotation of shaft 12. The links are balanced equally to opposite sides of the shaft 12. Upon rotation of shaft 12, the link 24 rotates in a plane perpendicular to the axis of rotation of shaft 12.

Figure 3:
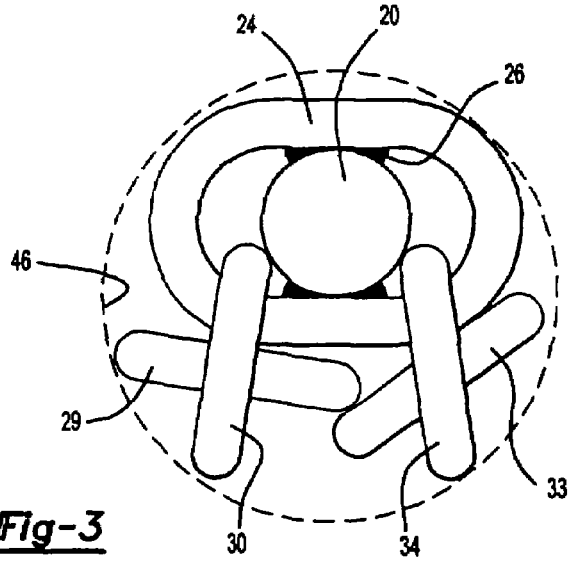
FIG. 3 is a cross sectional view taken on line 3-3 in FIG. 1 showing the relative position of the flexible member relative to an opening in a container.

In the preferred embodiment of the invention the mixing members or flail 22 is made up of seven links with the center link 24 fixed to lower end 20 of shaft 12 to be at the center of the generally oval chain link. As seen in FIG. 3 this is accomplished by forming a weld 26 joining diametrically opposite sides of shaft 12 to opposite elongated sides of center link 24. This leaves three links 28, 29 and 30 forming one chain flail to one side of center and links 32, 33 and 34 bring another chain flail extending to the opposite side of shaft 12.

The shaft 12 can be of any selected length. Typically the length can be slightly more than the depth of the container in which mixing is to take place. In some instances the shaft can be made of a much longer length to facilitate mixing from a standing position or to reach the bottom of deep containers.

It was found that with links having a cross sectional diameter of about 3/16 of an inch and an overall length of approximately 1 3/8 of an inch, a maximum of three chain links to either side of the tool shaft 12 was efficient for mixing. In that size of chain the use of four links for either side was ineffective because the outer links tended to fold back and not extend radially outwardly in a proper mixing attitude. With chains of this size it was found that a shaft with a diameter of 3/8 inches could be located in the opening in the center link 24 and diametrically opposed sides of shaft 12 could be welded in position centrally of link 24. The 3/8-inch diameter size is suitable for most hand held drills 18 with 3/8-inch chucks 16.

Figure 4:
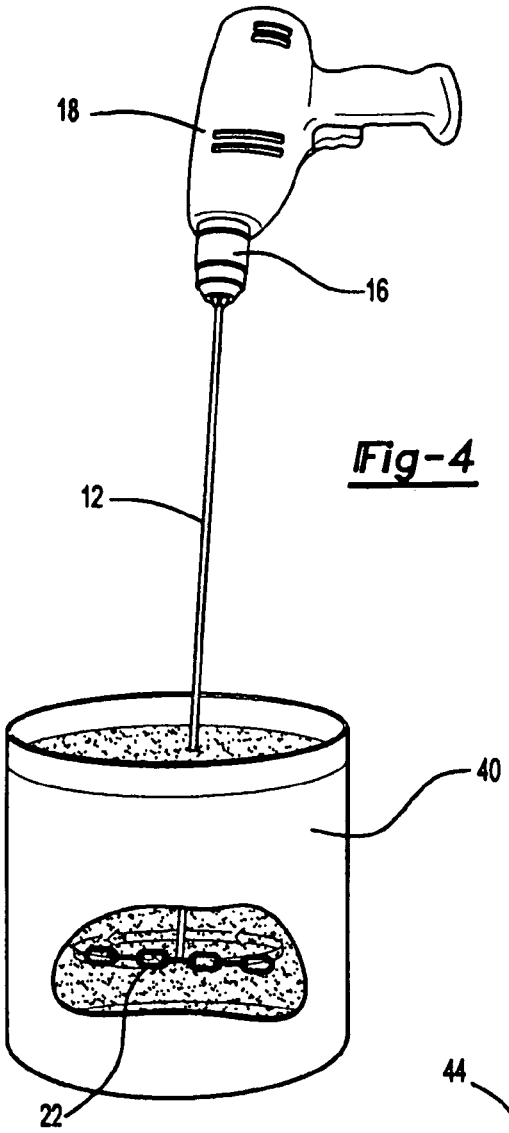
FIG. 4 is a perspective view of a mixing tool attached to a hand held drill motor mixing ingredients in a open top container with portions broken to show the position of the flexible mixing member.
Figure 5:
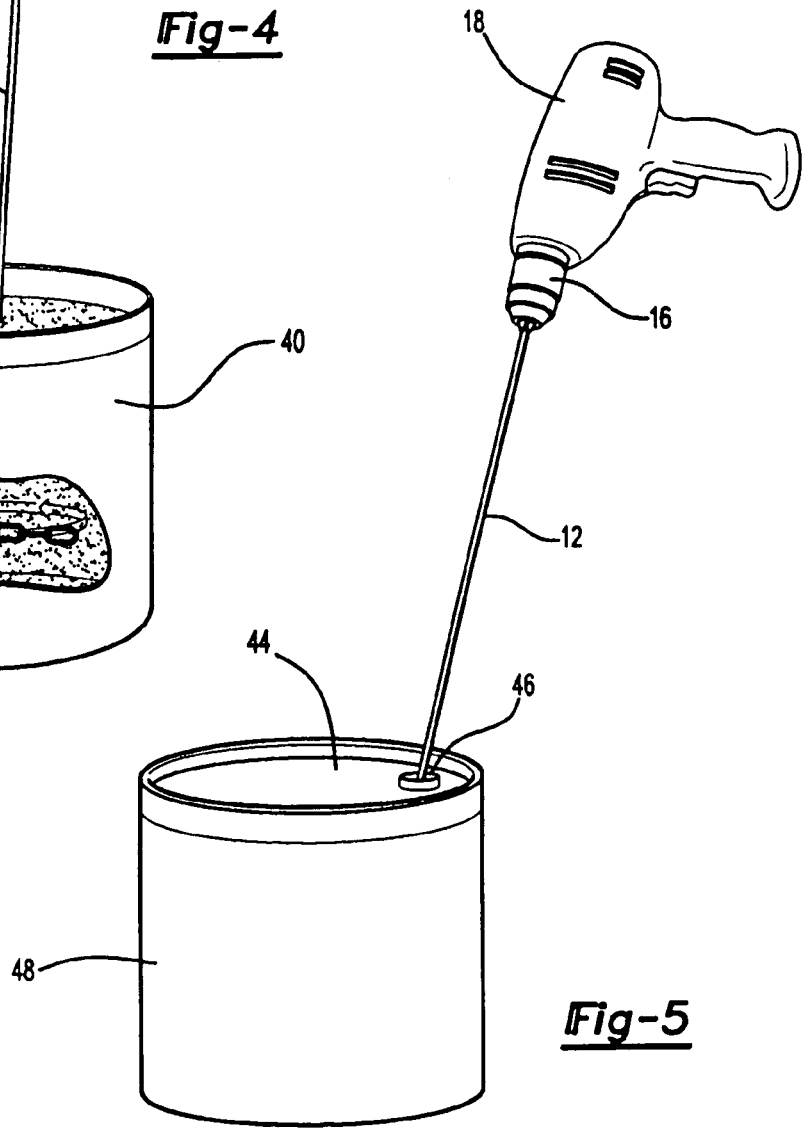
FIG. 5 is a view similar to FIG. 4 showing the mixing tool in use through a small opening in a closed top type of container.
Figure 6:
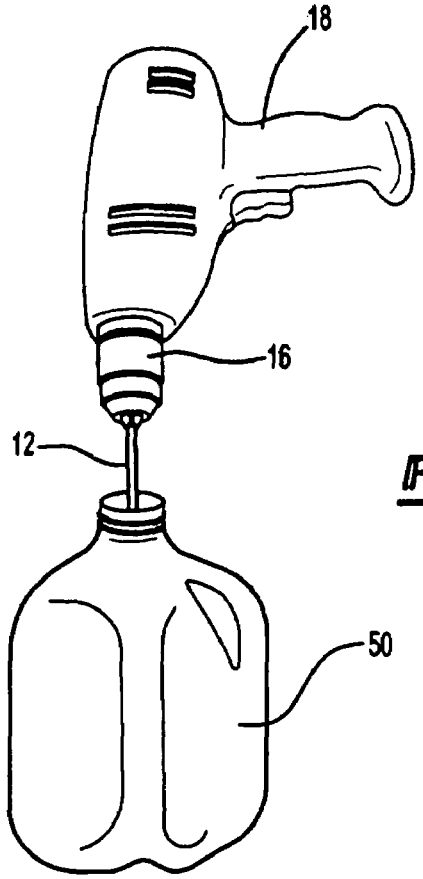
FIG. 6 is a mixing tool with a shorter drive shaft used in mixing in a gallon milk container.

In use the tool 10 with its shaft 12 can be locked into a conventional chuck 16 on a hand drill 18 indicated in FIGS. 4-6. Drill 18 preferably is of a variable speed so that mixing speeds can be selected. The tool 10 is placed in position above the material to be mixed in an open top container indicated at 40 in FIG. 4. If the container 40 is not covered, the chain flail 22 of the tool 10 can be immersed in the material and the hand drill 18 can be actuated to rotate the chain to cause agitation and mixing of the materials.

Figure 2:
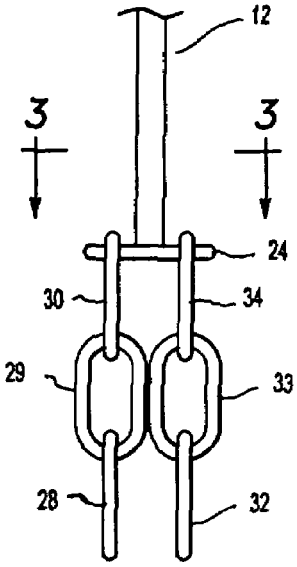
FIG. 2 is a view similar to FIG. 1 in a static condition with elements or links of a flexible mixing member on chains hanging vertically for insertion through an opening into a container with materials to be mixed.

In some cases, when liquids are to be mixed, it may be desirable to cover the container so that splashing does not occur. The conventional method would be to provide a hole to receive the shaft of the mixing tool centrally of the container top. Before connecting the shaft 12 to a chuck 16 the shaft is inserted through the hole from the bottom of the cover. Upon immersing the mixing tool in the material to be mixed and replacing the cover, the motor 16 can be attached and powered mixing can begin. With the present mixing tool, however, existing holes in covers can be used to insert the tool 10. For example, the container 40 can be provided with a cover 44 which as seen in FIG. 5 is fitted to the top of the container 40 and held in position by any conventional manner such as threading or clamps. A small round hole 46 is provided in the top of the cover 44 with a diameter slightly greater than the maximum dimension of a single link of the chain flail 22. With the tool 10 mounted in the hand held drill 18 the chain flail 22 can be inserted through the hole 46. This is accomplished by holding the drill motor 18 so the links to either side of shaft 12 hang downward as seen in FIG. 2. The links can be threaded through hole 46 usually without any guidance by the hand of the operator. With links threaded through opening 46 as seen in FIG. 3, tilting of center link 24 with shaft 12 to pass center link 24 through hole 46. Once inserted through the hole 46, tool 10 can be raised upwardly and downwardly axially relative to the shaft 12 to stir and to position the path of chain flail 22 at various levels in the container 40 to obtain complete mixing from the top to the bottom of the container of material to be mixed.

Preferably the chain flail and shaft 12 are made of stainless steel because of resistance to corrosion and because stainless steel is inert to many chemicals and materials to be mixed.

Contractors frequently receive paint and other chemicals in containers at the work site where the contents require agitation or mixing prior to use. Such containers 48 as viewed in FIG. 5 have a cover 44 provided with a bung opening which is covered by a cap (not shown) and that is offset from the axis of the container closer to the edge than to the center. The purpose of such openings 46 is to facilitate adding pigmentation or other additives prior to mixing and also to control pouring of liquid contents of such containers. With the present mixing tool 10 it is possible to remove the cap covering the bung opening 46 and insert the chain portion of the tool into the contents of the container without removing the container cover which is not possible with prior art mixing tools. Also, if the tool has a predetermined shaft length of approximately 36 inches, mixing can be accomplished without requirement for the worker to stoop or bend but can be done from a comfortable standing position.

As a further example of the versatility of the mixing tool 10 it can be used with the commonplace one-gallon milk container 50 seen in FIG. 6 which is made of plastic by blow molding with very thin walls. Such containers 50 can be used to mix smaller quantities of materials by placing the materials in the container and inserting the mixing tool of the present invention through a small open top 52. Moreover the tool 10 can be used to mix since engagement of the chain links with the walls of the container does not cause damage due to the smooth action of the flexible mixing member or chain as opposed to the more rigid blades of prior art mixers which in almost all cases could not be inserted through the opening of the container in any event.

Figure 7:
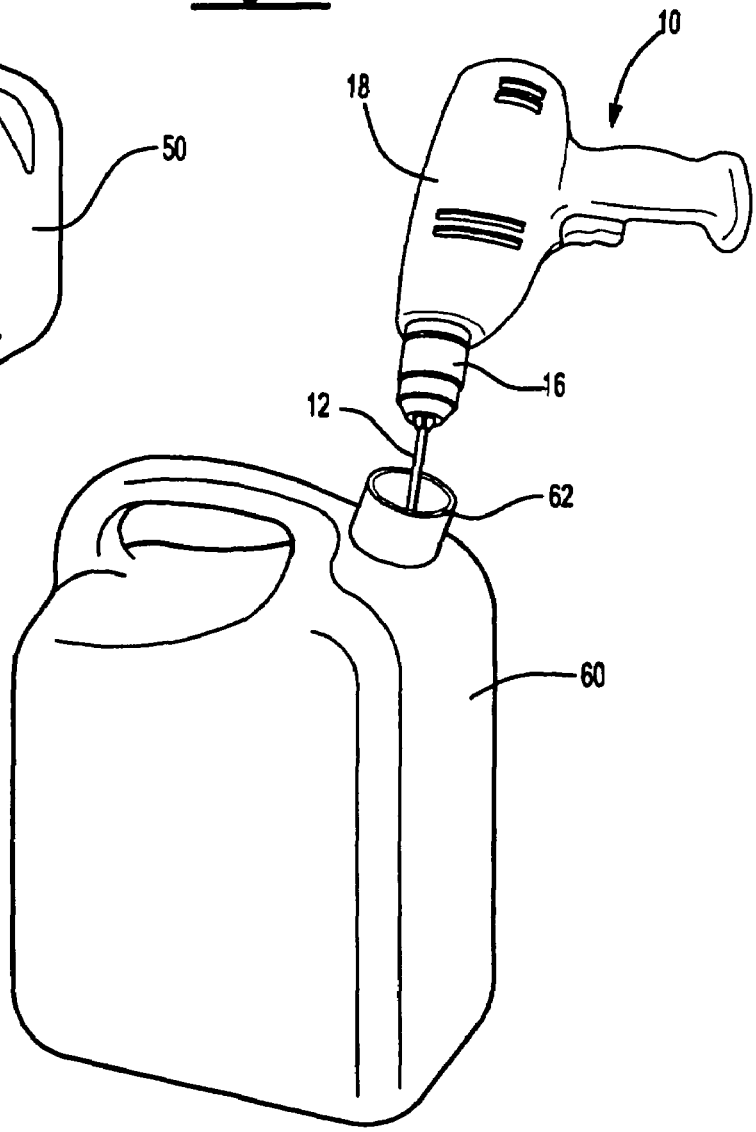
FIG. 7 is a view similar to FIG. 6 showing the mixing tool used for mixing ingredients in a one-gallon rectilinear container.

Another familiar container in which industrial chemicals, adhesives, etc. may be obtained is a rectilinear container 60 seen in FIG. 7 having a pouring nozzle 62. Again the mixing tool 10 is capable of being inserted through the opening without enlargement of any kind and to mix the contents of the container without concern because the links of the chain 22 can engage the walls of the container without damage and the mixing can be complete and thorough.

In use a mixing tool 10 with a long shaft 12 is held in a hand held drill motor 18 with a ⅜ inch chuck 16. Such hand held drill motors typically have variable speed which facilitates selection of mixing speeds for various materials to be mixed or agitated. With flexible mixing member 22 the tool 10 immersed in the materials the drill motor 18 can be activated to rotate the shaft 12 and the links of the chain will extend radially upon attainment of a certain rotational speed due to centrifugal force. Mixing can be accomplished in a closed container or in an open container. Very little splashing is involved if the chains are kept immersed in the material being mixed. Also, with the longer shaft, the user of the tool can move from container to container without stooping or bending.

Industrial chemicals frequently are available in large containers such as steel or plastic drums or barrels containing up to 55 gallons. Such containers typically have a bunghole offset from the axis of the cylindrical container and close to the perimeter. When delivered to the work site it is possible to mix the content of such large containers by opening the bung and inserting the chain of the mixing tool through the opening into the contents of the container. When the mixing tool has a long drive shaft of approximately 36 inches the tool can be maneuvered within the barrel container to mix its entire contents. This becomes particularly useful if the contents to be mixed require the addition of materials to the mix such as pigmentation or accelerators for chemical reactions.

Cleaning of the tool 10 is accomplished by immersing the mixing member 22 in a cleaning solution of water or other liquid and rotating the chain links until they are free of material. During such cleaning it is possible for the user to operate the drill motor 18 with one hand and have his other hand on the rotating shaft 12 of the tool 10 to help in the cleaning operation. This is partly due to the variable speed which makes it possible to operate the mixing tool at a very low rpm for hand cleaning of the tool.

One of the important aspects of the invention is the safety features. The rounded links of chain flail 22 of the flexible mixing member may at one time or another come into engagement with an operators body in which case depending on the rotation of the tool serious injury will not occur because of the roundness of the chain flails. Some pain may be experienced but serious injury should not be possible in the event of an accidental encounter of the chain flail with the body of an operator.

The mixing accessory for drills has been provided in which the mixing portion of the tool is formed by a flexible chain flail which is collapsible for insertion through a small opening in the container top or into the material to be mixed. The storage of the tool is easily accomplished by folding the chain generally parallel to the shaft 12 so that only a small space is required.

I claim:

1. A mixing tool comprising:

an elongated shaft having first and second ends, said first end being adapted for connection to a motor for rotating said shaft; and a link chain having an odd number of links, a central link of the odd number of links being fastened to the second end of said shaft for extension of the links radially from said shaft upon rotation in materials to be mixed.

2. The mixing tool of claim 1 wherein said central link is disposed to rotate in a plane perpendicular to the axis of rotation of said shaft.

3. A mixing tool for use with a hand held drill motor, comprising:

an elongated shaft having first and second ends, said first end being adapted for connection to a hand held motor; and a link chain having an intermediate portion connected to said second end of said shaft to extend radially there from upon rotation of said shaft, the intermediate portion including a link attached to the shaft that is bisected by an imaginary plane perpendicular to the axis of rotation of the shaft.

4. The mixing tool of claim 3 wherein said chain has an equal number of links extending radially to opposite sides of the axis of said rotating shaft.

5. A mixing tool for use with a hand held drill motor comprising:

an elongated rigid shaft having one end adapted for being held in a chuck of a drill motor;

a link chain having an odd number of links, a middle one of said links being attached to the other end of said shaft in a plane perpendicular to the axis of rotation of the shaft and such that the link chain extends radially from said shaft upon rotation of the latter.

6. The mixing tool of claim 5 wherein opposite ends of the link chain extend radially upon rotation of said shaft.

7. The mixing tool of claim 5 wherein said link chain is rotatable in a plane perpendicular to the axis of rotation of said shaft.

8. The mixing tool of claim 5 wherein said link chain has seven links and three of said links extend to opposite sides of said shaft.

9. The mixing tool of claim 8 wherein said shaft has a diameter substantially equal to the width of the opening in said links to facilitate positioning of said shaft relative to one of said links.

10. The mixing tool of claim 5 wherein said link chain is insertable in an opening in a container slightly larger than the length of a link of said chain.

11. The mixing tool of claim 5 wherein said chain is made of a stainless steel.

* * * * *